United States Patent [19]

Isobe

[11] 4,344,623

[45] Aug. 17, 1982

[54] THREE-DIMENSIONAL COMBINATION TOY

[75] Inventor: Toshiyuki Isobe, Tokyo, Japan

[73] Assignee: Daiwa Corporation, Tokyo, Japan

[21] Appl. No.: 213,030

[22] Filed: Dec. 4, 1980

[30] Foreign Application Priority Data

Sep. 1, 1980 [JP] Japan ..... 55-120758

[51] Int. Cl.[3] ..... A63F 9/08

[52] U.S. Cl. ..... 273/153 S

[58] Field of Search ..... 273/153 S, 155

[56] References Cited

U.S. PATENT DOCUMENTS 3,081,089 3/1963 Gustafson ..... 273/153 S X 4,097,049 6/1978 De Vos et al. ..... 273/153 S

FOREIGN PATENT DOCUMENTS 55-8193 3/1980 Japan ..... 273/153 S

*Primary Examiner*—Anton O. Oechsle

*Attorney, Agent, or Firm*—Koda and Androlia

[57] ABSTRACT

An improved three-dimensional combination toy may comprise a central part, a plurality of guide canopies installed above the central part to form guide spaces, (the guide canopies being laterally spaced apart from one another such that the spaces between the edges of adjacent guide canopies define guide tracks), seven movable blocks (each provided with a slide piece dimensioned to slide within and be retained by the guide spaces and attached to its block via an inwardly projecting slide leg free to move within the guide tracks) and a fixed block fastened to the central part. Preferably, a slide piece insertion opening is defined (by means of cutouts provided in the relevant canopy corners) at one particular rest position where a particular three of said guide canopies are adjacent to one another. The guide canopies may first be attached to the central part; the seven movable blocks may then be assembled with their respective slide pieces inserted into the guide spaces via the slide piece insertion opening, and finally the fixed block may be fastened to the central part above the slide piece insertion opening.

2 Claims, 8 Drawing Figures

THREE-DIMENSIONAL COMBINATION TOY

BACKGROUND OF THE INVENTION

1. Field of the Invention

The present invention relates generally to a three-dimensional combination toy, and more specifically relates to an improved three-dimensional combination toy in which different combinations of pictures or numbers may be produced by moving blocks in three dimensions.

2. Prior Art

Puzzle games derived from two-dimensional picture-combination or number-combination puzzles in which the movement of blocks may be in three dimensions, and which are played by rotating eight blocks installed around a central part four blocks at a time about any of three axes so that different combinations of pictures, patterns or numbers provided on the surfaces of the toy may be produced, are known as rotary combination toys, and an example of such a puzzle game has been described in Japanese Pat. No. 55-8193.

Such prior art combination toys allow patterns formed on three faces of each block in the toy to be successively combined. Accordingly, the combinations which can be produced are much more complex than the combinations which can be produced with conventional flat combination puzzles. Thus, interesting puzzle games suited to the ability of the players (i.e. with tasks ranging from the simple task of producing a specified combination on one face of the toy to the difficult task of producing specific combinations on all six faces of the toy) can be provided. However, prior art combination toys of this type suffer from the following drawbacks: The shapes of the individual parts of the toy are complicated and assembly is difficult, and furthermore, since it is difficult to assemble the toy with all the blocks in their correct positions on the central part of the toy, relatively skilled personnel are required for assembly of the toy.

SUMMARY OF THE INVENTION

The present invention has been designed with the above-mentioned limitations of the prior art in mind. Accordingly, a primary objective of the present invention is to provide an improved three-dimensional combination toy which can be easily assembled. Another related objective is to provide a three-dimensional rotary combination toy in which the individual blocks can be moved smoothly after the toy has been assembled.

An improved three dimensional combination toy in accordance with the present invention may comprise a central part, a plurality of guide canopies installed above said central part such that guide spaces are formed between said guide canopies and said central part, the guide canopies being laterally spaced apart from one another such that the spaces between the edges of adjacent guide canopies define guide tracks, seven movable blocks each being provided with a slide piece dimensioned to slide within and be retained by said guide spaces and attached to said block via an inwardly projecting slide leg free to move in said guide tracks, and a fixed block fastened to said central part.

Preferably, a slide piece insertion opening is defined at one particular rest position where a particular three of said guide canopies are adjacent to one another, said opening being defined by means of cutouts provided in the relevant corners of said particular three guide canopies. In accordance with certain method aspects of the present invention, the guide canopies may first be attached to the central part; the seven movable blocks may then be assembled with the respective slide pieces inserted into said guide spaces via said slide piece insertion opening, and finally the fixed block may be fastened to said central part above said slide piece insertion opening, thereby permanently closing said opening.

BRIEF DESCRIPTION OF THE DRAWINGS

For a further and better understanding of the present invention and a preferred exemplary embodiment thereof, reference is made to the following detailed description and the drawings in which.

DETAILED DESCRIPTION OF THE INVENTION

The following is a description of an exemplary embodiment of the present invention with particular reference to the above-enumerated figures.

Figure 1:
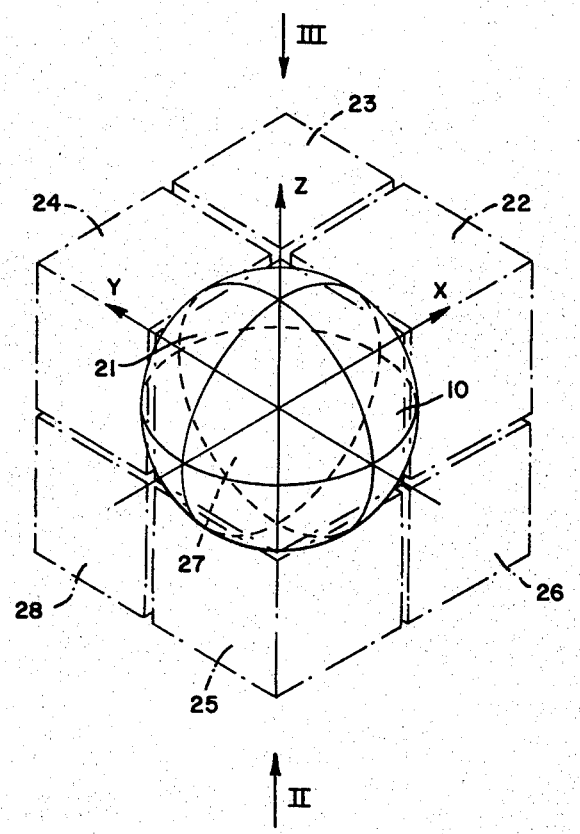
FIG. 1 is a rough illustration of the structure of an example embodiment of a three-dimensional combination toy provided by the present invention.

FIG. 1 illustrates the overall structure of the three-dimensional combination toy provided by this invention. A group of eight blocks, 21 through 28, are installed around the outside of a central part 10, so that said blocks can be rotated about the X, Y and Z axes of said central part. Among these blocks 21 through 28, seven blocks, 21 through 27, are movable blocks. A guide mechanism (described in detail below) allows blocks 21 through 27 to slide along predetermined paths over the surface of said central part 10. The remaining block is a fixed block 28, and is fastened directly to the aforementioned central part 10.

A first group of blocks consisting of blocks 21, 22, 23 and 24, and a second group of blocks consisting of blocks 25, 26, 27 and 28, can each be rotated as four-block units about the Z axis of the aforementioned central part 10. Similarly, a third group of blocks consisting of blocks 22, 23, 27 and 26, and a fourth group of blocks consisting of blocks 21, 24, 28 and 25, can each be rotated as four-block units about the X axis of the aforementioned central part 10, which as shown in the drawings, has an outer surface in the general shape of a sphere. Furthermore, a fifth group of blocks consisting of blocks 21, 22, 26 and 25, and a sixth group of blocks consisting of blocks 24, 23, 27 and 28, can be rotated as four-block units about the Y axis of the aforementioned central part 10. Accordingly, in this invention (as in conventional prior art toys of this type), the positions of the eight blocks 21 through 28 relative to each other can be altered as desired by rotating various groups of said eight blocks 21 through 28 (which in the illustrated and described embodiment appear to form a cube) about the X, Y and Z axes of the aforementioned central part 10. Thus, by applying desired pictures, patterns or colors to the exposed surfaces of the blocks 21 through 28 it is possible to produce a puzzle game, the object of which is to combine these pictures or patterns in specified combinations.

The mechanism of engagement between the eight blocks 21 through 28 and the central part 10 in the described exemplary embodiment of the three-dimensional combination toy provided by this invention will now be described with particular reference to FIGS. 2 through 6.

Figure 2:
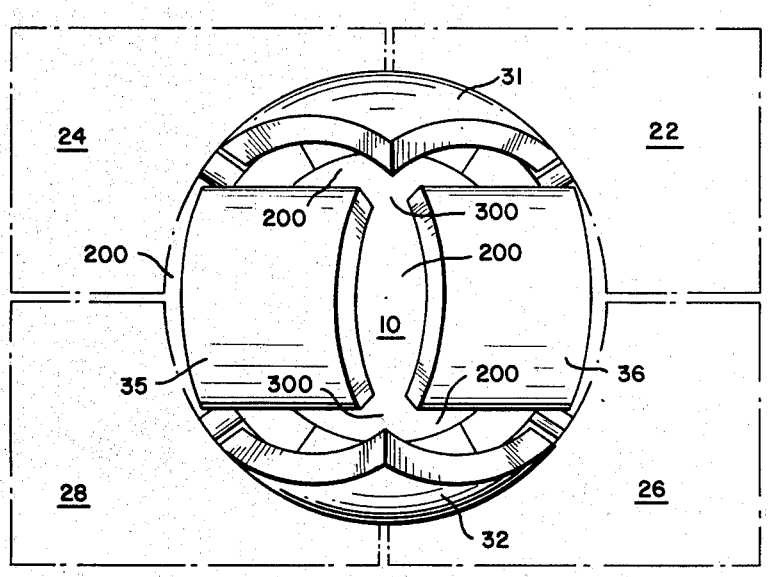
FIG. 2 is a front view from the direction indicated by the arrow II in FIG. 1.
Figure 3:
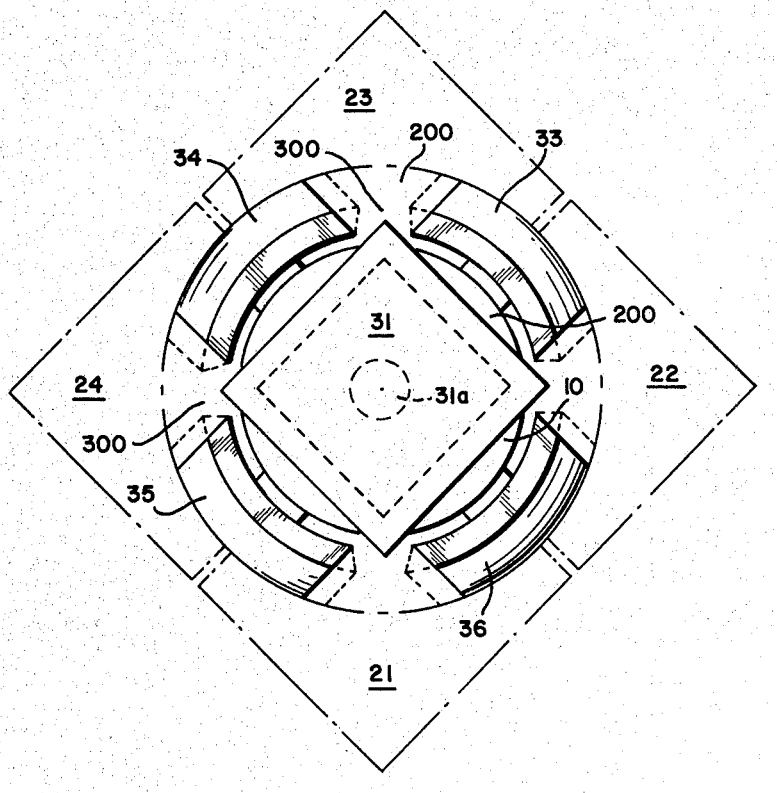
FIG. 3 is a plan view from the direction indicated by arrow III in FIG. 1.

FIG. 2 is a front three-quarter view of the toy from the direction indicated by arrow II (which lies in the XY plane) in FIG. 1. FIG. 3 is a plan view of the toy from the direction indicated by arrow III (which is parallel to the Z axis) in FIG. 1.

Figure 4:
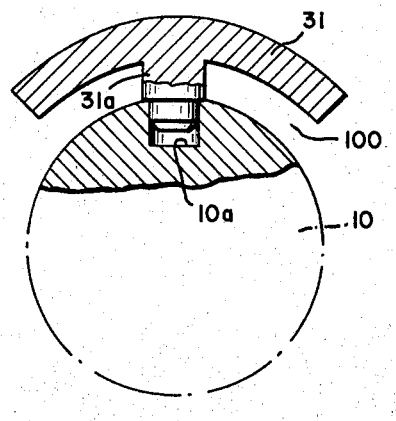
FIG. 4 is a partial cross section which illustrates the manner by which the guide canopies shown in FIG. 2 are fastened to the central part shown in the same figure.

Six guide canopies, 31 through 36, are installed on the surface of the said central part 10. Each of these guide canopies 31 through 36 is, as is best seen in FIG. 3, four-sided and when projected onto a flat plane perpendicular to this support axis 31*a*, has the general appearance of a square; thus, as shown in FIGS. 2 and 4, it may be described as a square shaped portion of a spherical surface of more or less uniform thickness which is installed above the corresponding surface portion of the aforementioned central part 10. As best seen in FIG. 3, the four sides of each canopy are generally aligned with a corresponding four sides of an imaginary cube circumscribed about central part 10.

FIG. 4 shows a cross section of one guide canopy 31. As is shown in FIG. 4, a support pole 31*a* is formed as an integral part of the aforementioned guide canopy 31 at the approximate center of said guide canopy 31. By inserting and fastening said canopy support pole 31*a* in a corresponding hole 10*a* formed in the aforementioned central part 10, the aforementioned guide canopy 31 can be correctly positioned and fastened in its proper position above said central part 10. In this way, predetermined guide spaces 10 are formed between the guide canopies 31 and the surface of the aforementioned central part 10. The function of these guide spaces 100 is to retain slide pieces associated with the movable blocks (described in detail below). The aforementioned central part 10 and guide canopies 31 through 36 are molded out of plastic, and it is desirable that an adhesive agent for use with plastic be used when each canopy support pole 31*a* is fastened in its respective hole 10*a*.

Figure 5:
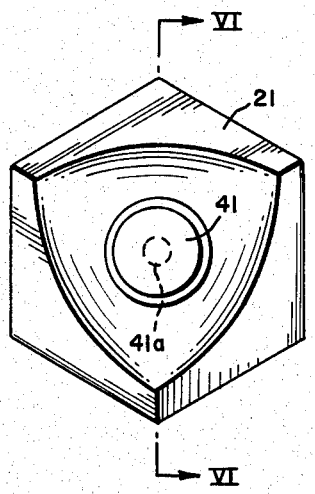
FIG. 5 is an oblique view of one of the movable blocks.
Figure 6:
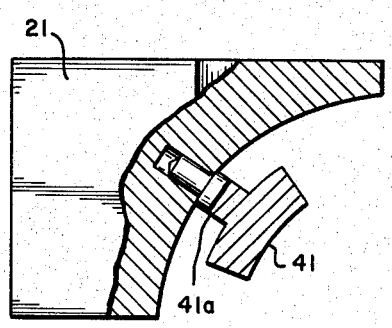
FIG. 6 is a cross section along line VI—VI in FIG. 5.
Figure 8:
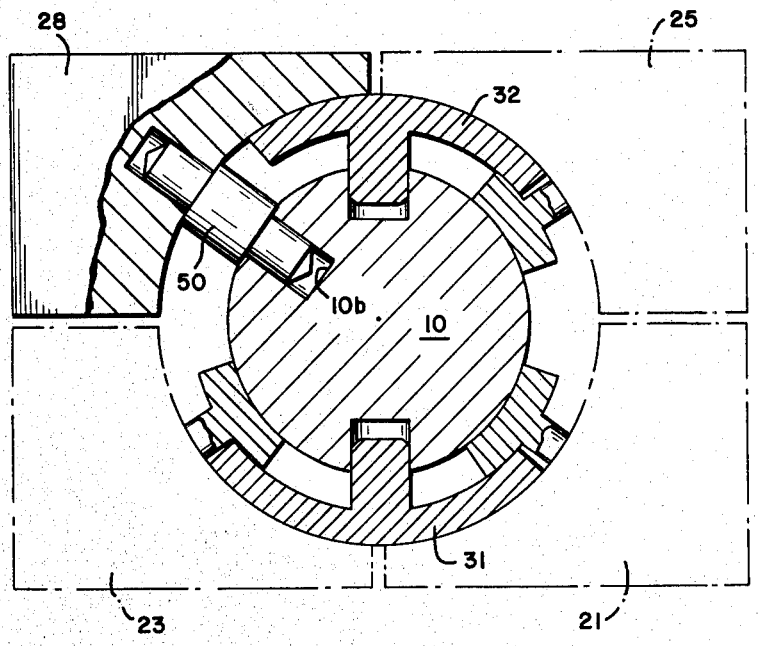
FIG. 8 is a partial cross section which illustrates the manner in which the fixed clock is fastened to the central part.

All of the aforementioned guide canopies 31 through 36 have approximately the same shape. Spaces which constitute guide tracks 200 are formed between the edges of adjacent guide canopys. The aforementioned eight blocks 21 through 28 include seven movable blocks, 21 through 27, which can be moved relative to the aforementioned central part 10, and one fixed block 28, which is fastened to the aforementioned central part 10. One such movable block 21 is illustrated in FIG. 5. As is shown in FIG. 5, the block is formed in the shape of a cube with one corner cut away along a spherical surface complementary to the exterior surfaces of the aforementioned guide canopies. Said block 21 is molded out of plastic. FIG. 6 is a cross section along line VI—VI in FIG. 5. A slide piece 41, which is as can be seen in FIGS. 5, 6 and 8, a circular shaped portion of a spherical surface having a generally constant thickness fastened to said movable block 21 via a slide leg 41*a* located along a center line oriented toward the center of said central part 10, is oriented so that it projects inwardly from said block 21. The sliding motion resulting from the confinement of this slide piece 41 to the area within said guide spaces 100 causes said block 21 to slide correctly above the surface of said central part 10. Furthermore, the sliding motion of said slide leg 41*a* is within guide tracks 200. Accordingly, the block 21 can be rotated about the X, Y and Z axes shown in FIG. 1.

The corner spaces formed where any three of said guide canopies 31 through 36 are adjacent to one another act as rest positions 300 for the aforementioned blocks 21 through 28. Each of the eight blocks 21 through 28 should be positioned when at rest in one of said rest positions 300. The movable blocks 21 through 27 are moved by moving the slide legs of said blocks from their respective rest positions 300 through said guide tracks 200 around the outside of the said central part 10. While in motion, each of said movable blocks 21 through 27 is prevented from pulling away from said central part 10 by the retention of its respective slide piece 41 inside said guide spaces 100.

Figure 7:
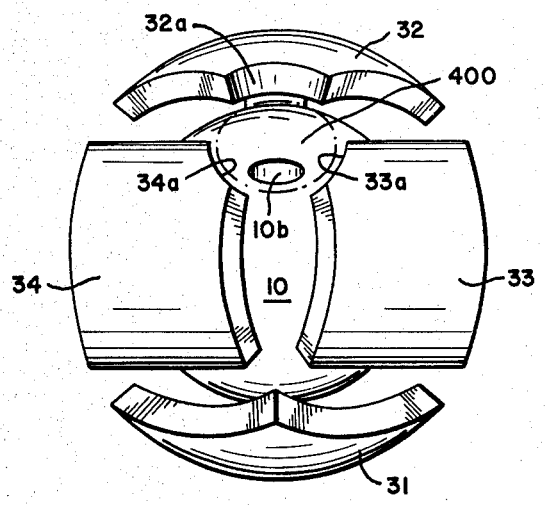
FIG. 7 is a front view showing the central part in FIG. 2 rotated 180°.

An important feature of the present invention is that a circular shaped (as best seen in FIG. 7) slide piece insertion opening 400 is formed at one of said rest positions 300 to allow insertion of the slide pieces 41 of said movable blocks 21 through 27 into said guide spaces 100. Accordingly, as is shown in FIG. 7, cutouts 32*a*, 33*a* and 34*a* are formed in the corners of guide canopies 32, 33 and 34 at the rest position where these three guide canopies are adjacent to each other. The slide piece insertion opening 400 formed by these cutouts is of just sufficient size to allow said slide pieces 41 to be inserted into the aforementioned guide spaces 100. In accordance with the present invention, therefore, it is extremely easy to assemble the movable blocks 21 through 27 so that they are free to slide around the outside of said central part 10.

An anchor hole 10*b* is formed in said central part 10 at the approximate center of said slide piece insertion opening 400. As is shown in FIG. 8, said fixed block 28 is anchored in this anchor hole 10*b* via an anchor pin 50. Accordingly, if the slide pieces of all of the movable blocks 21 through 27 are inserted into said guide spaces 100 via said slide piece insertion opening 400, and said fixed block 28 is then fastened to the said central part 10 via said anchor pin 50, said slide piece insertion opening 400 will be closed off by the fixed block. Furthermore, a standard position for the combination toy is determined by the fixed block 28 and the central part 10; this standard position can be used to position the movable blocks 21 through 27 in their respective rest positions 300.

In accordance with the present invention, as was described above, a slide piece insertion opening 400 is formed at one of the rest positions 300 formed by the aforementioned guide canopies 31 through 36. Accordingly, the slide pieces of the movable blocks 21 through 27 can be inserted into the aforementioned guide spaces 100 above the surface of the aforementioned central part 10 via said slide piece insertion opening 400. After these movable blocks 21 through 27 have been assembled, the assembly of the toy can be very easily completed by fastening the aforementioned fixed block 28 in place over the aforementioned slide piece insertion opening 400. Accordingly, there is no need for an assembly process using screws or involving the forced deformation of plastic parts (such as is necessary in the case of conventional toys of this type). The present invention thus makes it possible to conspicuously reduce the size of the gaps between adjacent blocks and between the blocks and the aforementioned cenral part, and to provide a combination toy with extremely smooth movements. Accordingly, the present invention makes it possible to provide a puzzle game which gives the impression of high quality.

In the embodiment described above, the height of said guide spaces 100 was approximately the same as the thickness of said slide pieces. However, by molding said guide canopies from resilient plastic and making the height of the guide spaces 100 slightly smaller than the thickness of the slide pieces, it would be possible to bias the slide pieces of the blocks in contact with said central part 10, and thereby eliminate rattling during block movement so that said movement would be even further improved.

As for the guide tracks 200 utilized by the present invention, it is necessary only that said guide tracks be located so as not to hinder the proper movements of the slide legs. Accordingly, the guide tracks described in the above embodiment can be altered as desired. Furthermore, the shapes of the aforementioned guide canopies can also be altered as desired as long as said slide pieces are still prevented from slipping out of said guide spaces 100.

Accordingly, the present invention makes it possible to provide an improved three-dimensional combination toy, and in particular, such an improved toy which does not require any precise finishing of parts and which is very easy to assemble.

Although the invention has been described in detail above with particular reference by to a present preferred exemplary embodiment thereof, it will be clear to the skilled artisian that other embodiments may be contructed in which some or all of the same objectives and advantages may be achieved with departing from the spirit of the invention.

Accordingly, the above disclosed description of the invention and of one or more particular embodiments thereof should not be deemed as in any way limiting the scope of the invention secured by these Letters Patent to that which has been specifically described; rather, said scope is to be construed only by reference to the following appended claims.

I claim:

1. A three-dimensional combination toy comprising:

a central part having a generally spherical outer surface;

six similarly shaped guide canopies each having four sides and having the general shape of a square portion of a spherical surface of substantially uniform thickness, installed above the outer surface of said spherical central part and spaced therefrom by means of an integrally formed support pole, such that guide spaces are defined between said guide canopies and said central part outer surface, said guide canopies being spaced apart from one another with each of said six guide canopies having its four sides generally aligned with the corresponding four sides of a face of a cube circumscribed about said spherical central part such that the edges of adjacent guide canopies define guide tracks;

seven movable blocks, each of which is provided with a slide piece and each having the general shape of a circular portion of a spherical surface of substantially uniform thickness and dimensioned to slide within and be retained by said guide spaces and which is attached to its respective block via an inwardly projecting slide leg free to move within said guide tracks; and a fixed block fastened to said central part;

wherein the eight corner spaces formed where any three of said guide canopies are adjacent to one another act as rest positions, and wherein said fixed block is fastened at a predetermined one of said rest positions and each of said slide legs is free to move from a chosen one of the remaining rest positions to a second chosen one of said remaining rest positions via said guide tracks.

2. The combination toy of claim 1 wherein a slide piece insertion opening of generally circular shape corresponding to said circular shape of the slide pieces of said movable blocks is formed at said predetermined rest position for said fixed block, said opening being defined by cutouts in the corners of the three guide canopies adjacent to said fixed block rest position whereby each of said seven movable blocks may be assembled to said central part by inserting its slide piece into said slide piece insertion opening and then sliding said slide piece through said guide spaces to a desired position about the outside of said central part.

* * * * *